US005568986A

United States Patent [19]

Sugai

[11] Patent Number: 5,568,986

[45] Date of Patent: Oct. 29, 1996

[54] PRINTER DEVICE

[75] Inventor: Ken Sugai, Kyoto, Japan

[73] Assignee: Rohm Co., Ltd., Kyoto, Japan

[21] Appl. No.: 439,447

[22] Filed: May 11, 1995

Related U.S. Application Data

[63] Continuation of Ser. No. 206,758, Mar. 7, 1994.

[30] Foreign Application Priority Data

Apr. 6, 1993 [JP] Japan ..... 5-079659

[51] Int. Cl.[6] ..... B14J 29/367

[52] U.S. Cl. ..... 400/695; 400/696; 15/102

[58] Field of Search ..... 101/401.1, 487; 400/695, 696, 700; 15/102

[56] References Cited

U.S. PATENT DOCUMENTS

| | | | |
|---|---|---|---|
| 2,120,325 | 6/1938 | Dixon | 101/423 |
| 3,559,570 | 2/1971 | Martel | 101/425 |
| 3,598,487 | 8/1971 | Mizuguchi | 355/27 |
| 3,656,948 | 4/1972 | Mammino | 96/1 |
| 4,181,620 | 1/1980 | Tsubuko | 430/114 |
| 4,263,745 | 4/1981 | Salahshour | 15/102 |
| 4,273,438 | 6/1981 | Nishikawa | 355/14 |
| 5,177,506 | 1/1993 | Katano | 346/151 |
| 5,400,123 | 3/1995 | Sato et al. | 15/102 |

FOREIGN PATENT DOCUMENTS

| | | | |
|---|---|---|---|
| 2951955 | 7/1981 | Germany | 400/696 |
| 0099353 | 8/1979 | Japan | 15/102 |
| 5262014 | 10/1993 | Japan | 400/695 |

*Primary Examiner*—Edgar S. Burr
*Assistant Examiner*—Anthony H. Nguyen
*Attorney, Agent, or Firm*—Brumbaugh, Graves, Donohue & Raymond

[57] ABSTRACT

A printer device is provided with an erasing portion for erasing recorded items of a medium on which characters or figures have been recorded, and a recording portion for printing or copying the surface of the medium having passed through the erasing portion by color fading ink or toner.

5 Claims, 1 Drawing Sheet

PRINTER DEVICE

This application is a continuation of application Ser. No. 08/206,758, filed on Mar. 7, 1994.

BACKGROUND OF THE INVENTION

The present invention relates to a printer device such as a laser printer or a copying machine which prints or copies characters or figures. More specifically, the present invention relates to a printer device which can erase recorded items printed or copied on a medium (hereinafter referred to as "paper") such as a paper so that the paper can be reused.

In the present specification, a printer device means a printing machine or a copying machine which can print, transfer or copy characters and figures by using ink, toner or the like. For example, a laser printer, a copying machine and the like are included.

According to a conventional laser printer or a copying machine, ink or toner made of, for example, carbon is adhered or burned to a paper surface so as to record characters or figures. Such ink or toner is made of a material which is chemically stable and does not fade in color, so that the recorded characters or figures do not semipermanently disappear.

Thus, although the conventional printing method is convenient for the long preservation of documents, it has a problem that once printed paper can not be reused.

With the recent rapid increase of an information amount and development of OA machines such as a personal computer and a word processer, opportunities of copying or printing (hereinafter referred to as simply "printing") information are greatly increased. Further, the amount of printed matter which is used only for a short time after printing, is increasing more and more. That is, in a case where an original of information exists in the printed matter or an OA machine, and when a user reads the information at a place separated from a terminal device, the information is outputted from the OA machine to form the printed matter. However, when the copied matter is once used, it often becomes useless. Further, since the original of information stored in the OA machine is often renewed, the lifetime of the printed matter as the copy of the original is very short. Conventionally, in such a case, the printed matter is thrown away after at most, the rear surface of the paper is used. Accordingly, there arise problems that the amount of dust remarkably increases and the paper is wasted, which leads to the destruction of global environment such as forest resources.

SUMMARY OF THE INVENTION

The present invention has been made to solve such problems and has an object to provide a printer device which can reuse the paper when the printed matter is only used after printing for such a short time as several hours to several days.

The printer device of the present invention is characterized by comprising an erasing portion for erasing recorded items of a medium on which characters or figures have been recorded, and a recording portion for newly printing or copying the surface of the medium having passed through the erasing portion by color fading ink or toner.

According to the printer device of the present invention, the erasing portion and the recording portion are provided, and the printed matter is printed in the recording portion by using the color fading ink or toner, so that after erasing the recorded portion on the printed matter so as to return the portion into the original state, new information can be recorded on the portion.

DETAILED DESCRIPTION OF THE PREFERRED EMBODIMENTS

Figure 1:
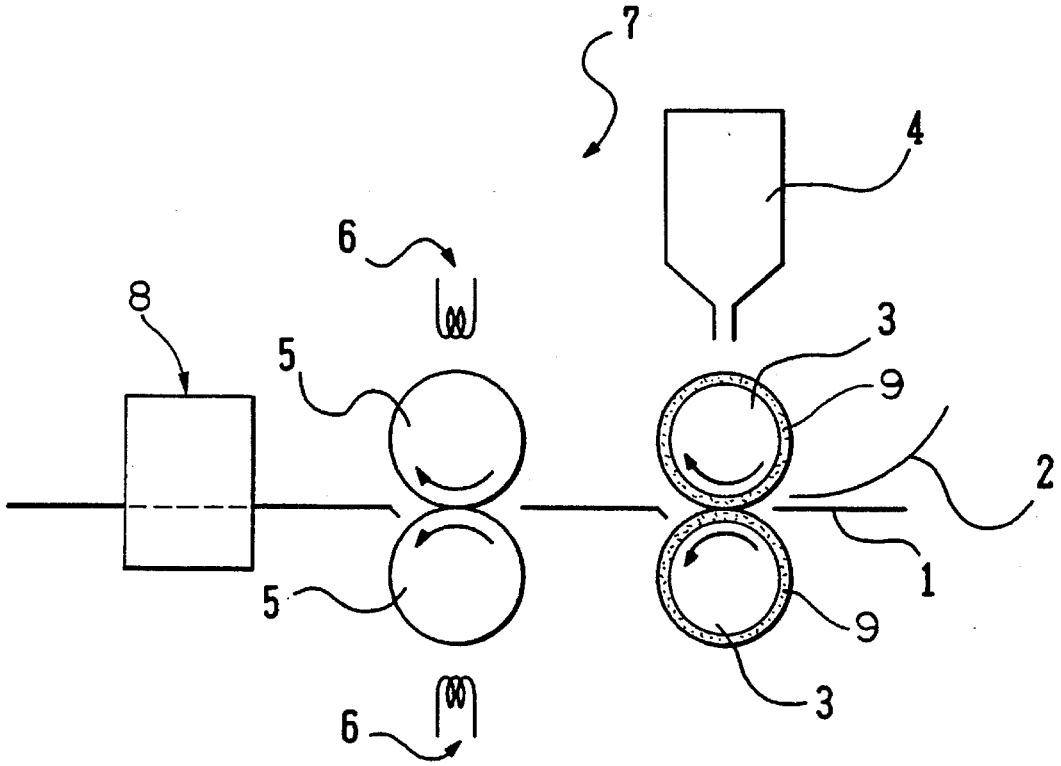
FIG. 1 is an explanatory view showing an embodiment of an erasing portion of a printer device of the persnet invention.

A printer device of the present invention will next be described with reference to the drawing. FIG. 1 is an explanatory view showing an erasing portion of a printer device according to an embodiment of the present invention, which is used at a time when characters or figures recorded on the printed matter are faded in color.

The printer device of the present invention is constructed of a conventional recording portion 8, illustrated schematically in FIG. 1, which performs printing by applying a color fading ink or toner, and an erasing portion 7 for erasing recorded items previously printed. The recording portion 8 may be made of a printing portion of a conventional laser printer or a printing machine, or a transferring portion of a copying machine as it is. The printer device of the present invention is characterized in that the color fading ink or toner is used and the erasing portion for erasing recorded items is provided in front of the recording portion.

As the color fading ink or toner, there is used an organic pigment such as methyl violet lake (tannin lake), peacock blue lake (acid lake), acid green lake, naphthol yellow S lake, quinoline yellow lake, prussian orange, para red, lithol red, brilliant scarlet G, bordeaux 5B, or alkali blue toner, mixed with a spreader having high ultraviolet absorption index such as denatured phenol resin, lime de rosin, or dammar. By suitably selecting the kinds of the pigment and spreader, or the mixing ratio of the pigment and spreader, it is possible to adjust a color fading time of the ink or toner. The organic pigment is more easily faded in color than an inorganic pigment, and the above-mentioned pigments are preferable. However, other organic pigment or inorganic pigment can be used in accordance with an object of the printed matter. Among the above-mentioned pigments, especially methyl violet lake, peacock blue lake and acid green lake are easily faded in color, so that they are especially preferable for the printed matter which becomes unnecessary in several days. Further, by mixing a catalyst for accelerating a chemical reaction, it is also possible to adjust a treatment time of color fading.

Although the above-mentioned organic pigment is apt to be faded in color for ultraviolet, it may be one which is faded in color by reaction with a specific chemical agent.

Next, an erasing portion will be described. FIG. 1 shows an example of an erasing portion of a printer device of the present invention, which is provided with two rotatable erasing rollers 3, drying rollers 5, and a support plate 1 for guiding a paper 2 to the erasing rollers 3. An agent vessel 4 for supplying an erasing agent to the erasing rollers 3 is disposed near the erasing rollers 3. A heating device 6 for keeping the drying rollers 5 at a high temperature is disposed near the drying rollers 5. The surface of the erasing rollers 3 is covered with a spongy material 9 which includes the erasing agent supplied from the agent vessel by a suitable amount. Thus, when the paper 2 as the printed matter passes through the erasing rollers 3, the toner of the printed portion on the paper 2 is faded in color by the reaction with the erasing agent, so that the paper 2 becomes in the original state prior to printing. Then, it passes through the drying rollers 5 so that moisture due to the erasing agent evaporates.

Figure 2:
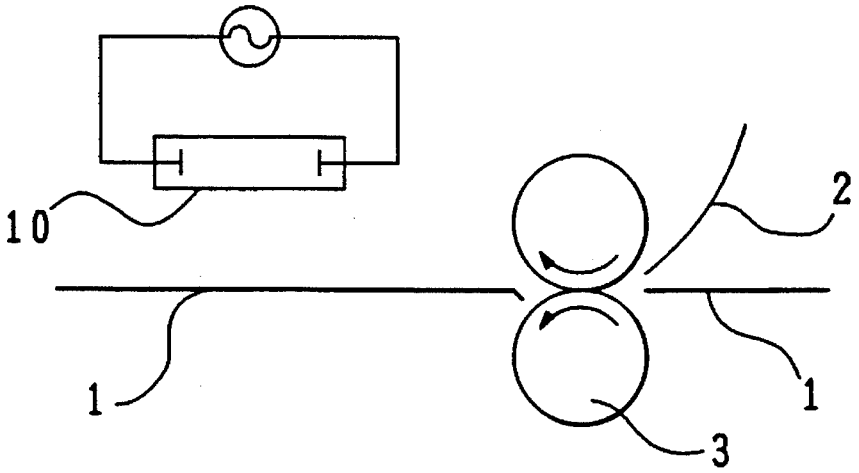
FIG. 2 is a schematic view showing an erasing portion employing an ultraviolet irradiation device according to the present invention.

In the above description, there is described an example where the recorded items of toner or the like is faded in color by the chemical agent in the erasing portion. However, the erasing portion is not restricted to such a type. For example, the erasing portion may use erasing means such as an ultraviolet irradiation device. When using the ultraviolet irradiation, as shown in FIG. 2, an ultraviolet lamp 10 or the like is disposed over the upper surface of a paper 2 transferred by the rollers 3 or the like, and the recorded items can be erased by only irradiation of ultraviolet. In this case, it is needless to say that the drying rollers 5 and heating device 6 are not necessary.

As described above, according to the printer device of the present invention, a color fading time of ink can be adjusted in accordance with the use of printed matter by suitably selecting the kinds of pigment and spreader, mixing ratio thereof, an additive amount of catalyst and the like.

Further, if printing is conducted using ink which fades in color in response to only light having the same wavelength as irradiated light of a copying machine, the printed matter can not be copied so that the secrecy of document can be effectively protected.

According to the printer device of the present invention, unnecessary recorded items can be easily erased, and the paper can be used repeatedly, so that the cost of paper can be reduced and also the forest resources can be protected.

Further, in a case where an original is often renewed, if printing is conducted after suitably adjusting components and concentration of ink, it is possible to make renewal time and color fading time of ink coincide with each other, so that old information can be sequentially erased.

What is claimed is:

1. In combination, a printer device and a sheet record medium, comprising:

a sheet record medium containing a visible image recorded in color fading ink or color fading toner;

erasing means for erasing the visible image recorded on the sheet record medium in color fading ink or color fading toner by fading the ink or toner in the image;

guiding means for guiding the sheet record medium through the erasing means; and recording means for printing or copying a visible image on a surface of said sheet record medium after it has passed through said erasing means by applying a color fading ink or color fading toner.

2. The combination of claim 1, wherein said erasing means comprises a pair of rotatable erasing rollers covered with a spongy material, and an agent vessel for supplying an erasing agent to said erasing rollers, said erasing agent being absorbed by said spongy material.

3. The combination of claim 1, wherein said erasing means comprises an ultraviolet irradiation device.

4. The combination of claim 1, wherein said color fading ink or toner is made of an organic pigment mixed with a spreader having high ultraviolet absorption index.

5. The combination of claim 4, wherein said organic pigment is one selected from a group consisting of methyl violet lake, peacock blue lake, acid green lake, naphthol yellow S lake, quinoline yellow lake, prussian orange, para red, lithol red, brilliant scarlet G, bordeaux 5B, and alkali blue toner, and said spreader is one selected from a group consisting of denatured phenol resin, lime de rosin, and dammar.

* * * * *